US005829684A

United States Patent [19]

Fishcer

[11] Patent Number: 5,829,684

[45] Date of Patent: Nov. 3, 1998

[54] PENDENT-TYPE DIFFUSER IMPINGEMENT WATER MIST NOZZLE

[75] Inventor: Michael A. Fishcer, West Kingston, R.I.

[73] Assignee: Grinnell Corporation, Cranston, R.I.

[21] Appl. No.: 742,599

[22] Filed: Oct. 28, 1996

[51] Int. Cl.[6] ..... B05B 1/26

[52] U.S. Cl. ..... 239/524

[58] Field of Search ..... 239/527, 525, 239/524, 504; 169/37, 38

[56] References Cited

U.S. PATENT DOCUMENTS

| | | | |
|---|---|---|---|
| 400,688 | 4/1889 | Kersteter . | |
| 447,004 | 2/1891 | Nagle . | |
| 450,574 | 4/1891 | Byers . | |
| 2,310,798 | 2/1943 | Lewis | 239/544 |
| 2,361,144 | 10/1944 | Loepsinger | 239/424 |
| 2,493,982 | 1/1950 | Lee | 239/544 |
| 3,051,397 | 8/1962 | Hanson | 239/504 |
| 3,603,512 | 9/1971 | Ham | 239/504 |
| 4,580,729 | 4/1986 | Pounder | 239/524 |
| 4,585,069 | 4/1986 | Whitaker | 239/504 |
| 4,989,675 | 2/1991 | Papavergos | 169/14 |
| 5,014,790 | 5/1991 | Papavergos | 169/44 |
| 5,392,993 | 2/1995 | Fischer | 239/522 |
| 5,505,383 | 4/1996 | Fischer | 239/518 |
| 5,513,708 | 5/1996 | Sundholm | 169/37 |

FOREIGN PATENT DOCUMENTS

| | | | |
|---|---|---|---|
| 47902 | 2/1970 | U.S.S.R. | 239/524 |
| 1621988 | 1/1991 | U.S.S.R. | 169/137 |
| WO 93/00962 | 1/1993 | WIPO | A62C 35/58 |

*Primary Examiner*—Kevin Weldon
*Attorney, Agent, or Firm*—Fish & Richardson P.C.

[57] ABSTRACT

A pendent-type diffuser impingement water mist fire protection nozzle has a body defining an orifice and an outlet for flow of fluid from a source, and a diffuser positioned for impingement of the flow of fluid thereupon, the outlet and diffuser being disposed generally coaxial with the orifice. The diffuser defines an inner surface opposed to water flow from the outlet and an opposite outer surface. The diffuser inner surface defines a generally horizontal base area facing the nozzle outlet, an outer area spaced radially outwardly from, and disposed further from the outlet relative to, the base area, the outer area defining a generally continuous, circumferential peripheral edge, and an intermediate region extending between the base area and the outer area, the intermediate region defining a slanted surface disposed at a predetermined acute angle to the horizontal. The slanted surface defines a plurality of through holes from the inner surface of the diffuser to the opposite outer surface.

44 Claims, 3 Drawing Sheets

PENDENT-TYPE DIFFUSER IMPINGEMENT WATER MIST NOZZLE

This invention relates to water mist nozzles for fire protection service.

BACKGROUND OF THE INVENTION

Water mist fire protection systems are typically classified by one of several different criteria. These criteria include: (1) the method by which mist is generated; (2) the mode of nozzle operation, e.g. individual automatic, object protection (local application) array system, or total compartment deluge array system; and (3) the range of operating pressures. Water mist fire protection systems can also be subclassified by: water supply, e.g. separate or self-contained; nozzle operation, e.g. continuous or intermittent; water supply temperature (measured at the nozzle); and use of an additive. (Note: In this disclosure, the term "water" refers interchangeably to natural water and to appropriate mixtures of natural water and one or more additives for enhancement of fire fighting properties of a water mist fire protection system.)

The main types of water mist nozzles for fire protection include: diffuser impingement, pressure jet, gas-atomizing, and jet interaction.

Diffuser impingement nozzles operate by impacting a medium velocity, relatively coherent water jet against a diffuser. The diffuser breaks the stream into a high momentum mist with the widest range of droplet sizes (compared to other types of water mist nozzles), e.g. typically, 90% of the droplets are smaller than 600 microns. Impingement nozzles presently on the market operate over a range of pressure from about 7 bar (100 psi) to 17.2 bar (250 psi). For fire protection service, impingement nozzles can be individually automatically operating, e.g. for Class A ordinary combustible applications, or they can be used as open nozzles in an object protection system or a total compartment deluge system, e,g, for Class B flammable liquid hazard applications. Under certain conditions, individually operating diffuser impingement nozzles may be used for object protection systems where the primary hazard is Class B. In prior art applications, variations of impingement water mist nozzles have included use of multi-tined, spherical, or spiral-type diffuser, and also use of superheated water in combination with a dispersion chamber internal to the nozzle. An automatically operating water mist nozzle of the multi-tined diffuser impingement type, for fire protection service, is described in Fischer U.S. Pat. No. 5,392,993. An open water mist nozzle of the spherical diffuser impingement type is described in Fischer U.S. Pat. No. 5,503,383.

Pressure jet water mist nozzles function by discharging high velocity streams of water through a number of relatively small orifices, typically employing a swirl action device within the chambers leading to the orifices, to assist in break-up of the water streams. A wide selection of pressure jet nozzle designs are available, operating over a range of pressure from about 5 bar (70 psi) to 280 bar (4060 psi). Pressure jet nozzles can also be individually activating or open. The open nozzles are employed as part of a local application or in a total compartment deluge system, and they have been combined with super-heated water to facilitate vaporization of the spray. Typically, 90% of the droplets of a pressure jet nozzle are smaller than 150 microns, at least for those operating at the high end of the pressure range. An automatic pressure jet nozzle for fire protection service is described in Sundholm U.S. Pat. No. 5,513,708. A pressure jet nozzle of the open type is illustrated in Sundholm International Pat. application WO 93/00962 (dated Jul. 20, 1993).

Gas-atomizing water mist nozzles (also referred to as twin-fluid nozzles) generate water mist by combining compressed gas with water in a mixing chamber located just upstream of the discharge orifices. Gas-atomizing nozzles utilize water pressure of about 5 bar (75 psi), and 90% of the droplets generated are typically smaller than about 250 microns. Gas-atomizing nozzles are typically limited to use in local application or total compartment deluge systems, since open nozzles are required to assure that the piping network provides the required combination of gas pressure and water pressure within the nozzles. Gas-atomizing water mist nozzles for fire protection purposes are illustrated in: Loepsinger U.S. Pat. No. 2,361,144 as well as Papavergos U.S. Pat. No. 4,989,675 and U.S. Pat. No. 5,014,790.

In jet interaction type water mist nozzles, multiple pairs of fine fluid jets strike each other at acute angles, to break-up the water streams. Jet interaction nozzles typically operate over a range of pressure from 3 bar (45 psi) to 7 bar (100 psi), and their use is generally limited to manual hose nozzles for the extinguishment of low volatility flammable liquid fires by cooling and dilution, since the spray has relatively low momentum. Jet interaction water mist nozzles for fire protection service are illustrated in Lewis U.S. Pat. No. 2,310,798 and Lee U.S. Pat. No. 2,493,982.

SUMMARY OF THE INVENTION

According to the invention, a pendent-type diffuser impingement water mist fire protection nozzle comprises a body defining an orifice and an outlet for flow of fluid from a source, the orifice defining an axis, and the outlet being disposed generally coaxial with the orifice, and a diffuser disposed generally coaxial with the axis of the orifice and positioned for impingement of the flow of fluid thereupon. The diffuser defines an inner surface opposed to water flow from the outlet and an opposite outer surface. The diffuser inner surface defines a generally horizontal base area facing the nozzle outlet, an outer area spaced radially outwardly from, and disposed further from the outlet relative to, the base area, the outer area defining a generally continuous, circumferential peripheral edge, and an intermediate region extending between the base area and the outer area, the intermediate region defining a slanted surface disposed at a predetermined acute angle to the horizontal. The slanted surface defines a plurality of through holes from the inner surface of the diffuser to the opposite outer surface.

Preferred embodiments of the invention may include one or more the following additional features. The predetermined acute angle of the slanted surface is in the range of about 4° C. to 60° C., preferably about 10° C. to 30° C., and more preferably about 18° C. The plurality of through holes defined by the slanted surface comprises at least four through holes, preferably at least eight through holes, and more preferably ten through holes. The through holes defined by the slanted surface have a first, relatively wider end and a second, relatively narrower end, the first, relatively wider end being closer to the axis than the second, relatively narrower end. Preferably, the first, relatively wider end has a radius in the range of about 0.03 inch to about 0.09 inch, more preferably about 0.046 inch, and the second, relatively narrower end has a radius in the range of about 0.02 inch to about 0.07 inch, more preferably about 0.032 inch, measured in a flat, blank form of the diffuser. The through holes defined by the slanted surface have a length in the range of about 0.10 inch to about 0.25 inch, preferably about 0.174 inch, measured in a flat, blank form of the diffuser. The through holes defined by the slanted surface are generally equally spaced about the axis. The through holes defined by the slanted surface are generally equally spaced from the axis at a distance in the range of about 0.15 inch to about 0.45 inch, preferably about 0.250 inch, measured in a flat, blank form of the diffuser. The pendent-type diffuser impingement water mist fire protection nozzle further comprises a pair of nozzle frame arms extending from the body and disposed generally in a first plane including the axis, with the diffuser mounted thereupon, and adjacent pairs of the through holes positioned with equal spacing from the first plane extending therebetween. The generally horizontal base area facing the sprinkler outlet has an outer diameter of about 0.414 inch. The outer area spaced radially outwardly from, and disposed further from the outlet relative to, the base area has an inner diameter of about 0.900 inch. The outer area is disposed further from the outlet relative to the base area by a vertical distance of about 0.059 inch. The diffuser, in final, formed state, has an outer diameter of about 0.995 inch. The diffuser, in flat, blank state, has an outer diameter of about 1.000 inch. The pendent-type diffuser impingement water mist fire protection nozzle further comprises a spray pattern of water flow from the outlet impacted upon the diffuser, the spray pattern comprising a superimposed combination of an outer umbrella-shaped pattern component and an inner conical-shaped pattern component. The sprinkler has a K-factor in the range of about 0.10 to about 1.0, preferably about 0.15 to about 0.70, and more preferably about 0.50 to about 0.70.

The invention concerns a pendent-type, diffuser impingement water mist nozzle having a body defining an inlet for connection to a source of water under pressure, an outlet, and an orifice normally located just upstream of the outlet, and a substantially horizontal water distribution diffuser positioned downstream of, and opposing, the outlet. In diffuser impingement nozzles of the invention, the outlet may be normally closed by a plug held in place by a thermally responsive element configured to automatically release the plug when a sufficiently elevated temperature is sensed. Upon operation, the water mist nozzles of the invention, whether individually automatically operated or used open as part of a local application or total flooding system, a vertically directed, relatively coherent, single stream of water (downward for pendent nozzles and upward for upright nozzles) rushes through the outlet, from the orifice, towards the diffuser. As it impacts upon the diffuser, the water is diverted generally radially downward and outward, breaking up into a spray pattern, the configuration of which is, in large part, a function of the diffuser design, and it is projected over the intended area of coverage, i.e., the protected area.

In Apr., 1992, the International Maritime Organization (IMO) amended the regulations in Chapter II-2 of their SAFETY OF LIFE AT SEA (SOLAS) requirements to specify that all ships carrying more than 36 passengers in international transport and entering service after Oct. 1, 1994, would be required to be protected in all applicable areas by either an automatic sprinkler system, or its equivalent. Ships constructed prior to the 1974 edition of SOLAS will be required to be retrofitted by 1997, and ships constructed in accordance with the 1974 edition of SOLAS must be retrofitted by 2005, or within 15 years of construction, whichever comes later.

Water mist nozzles of the present invention meet the SOLAS requirements for an automatic sprinkler system equivalent, as established at the 40th Session of the IMO Sub-Committee on Fire Protection in Jul., 1995. The evaluation standards established by the IMO Sub-Committee on Fire Protection for determining whether an equivalent system, e.g. using water mist nozzles, will perform acceptably under fire conditions are contained in "Fire Test Procedures For Equivalent Sprinkler Systems in Accommodation, Public Space and Service Areas on Passenger Ships" and "Component Manufacturing Standards for Water Mist Nozzles" which were adopted by the IMO Assembly on Dec. 14, 1995 [Resolution A.800(19)].

These IMO fire test procedures comprise various fire tests corresponding to different SOLAS occupancy classifications. For example, the so-called "luxury cabin" fire test series correlates to fire protection of accommodation spaces of minor and moderate fire risk, as well as sanitary and similar spaces up to 50 $m^2$ (538 $ft^2$) in area. A further example is the so-called "public spaces" fire test series which correlates to fire protection of control stations, accommodation spaces of minor, moderate and greater fire risk, and sanitary and similar spaces over 50 $m^2$ (538 $ft^2$) in area.

The fire tests used to confirm the acceptability of water mist nozzles for fire protection service in the public space category include the so-called "disabled nozzle corner public space fire test" performed at ceiling heights of 2.5 m (8.2 ft.) and 5.0 m (16.4 ft.). This is an extremely severe test with requirements set at a level that cannot be achieved by most automatic sprinklers, in order to ensure that the fire protection performance of water mist nozzles, submitted as being equivalent to an automatic sprinkler system, had an appreciable safety factor. In the disabled nozzle corner fire tests, where the loss of combustibles must be maintained below certain specified levels with the nozzle closest to the fire being prevented from operating, the pendent-type diffuser impingement water mist nozzle of the invention performed exceptionally well.

There are presently no established standards or guidelines for evaluating water mist nozzles on the basis of minimum amount of water which must be collected per unit time over specified areas (i.e., density), e.g. under one nozzle, between two nozzles, and between four nozzles, when the nozzles are discharging under specified flowing (residual pressure) conditions. Each individual nozzle designer must establish the minimum required nozzle flow in combination with minimum required operating pressure and desired configuration of nozzle spray pattern required to achieve extinguishment (i.e. complete suppression of a fire until there are no burning combustibles); suppression (i.e. a sharp reduction in the rate of heat release of a fire with no re-growth); or control (i.e. limiting the growth of a fire by pre-wetting adjacent combustibles and controlling gas temperatures at the ceiling to prevent structural damage) of selected test fire scenarios, as necessary or as desired, over the area to be protected by the water mist nozzle.

The mechanisms by which water mist spray acts to extinguish, suppress, or control a fire can be a complex combination of the following factors, depending on the nature of the hazard being protected:

(1) Heat extraction from the fire as water is converted into vapor and the fuel is cooled;

(2) Reduced oxygen levels as the water vapor displaces oxygen near the fire;

(3) Direct impingement wetting and cooling of the combustibles;

(4) Enveloping of the protected area to cool gases and adjacent combustibles, as well as to pre-wet the adjacent combustibles while blocking them from the transfer of radiant heat; and (5) Dilution of flammable vapors by the entrainment of water, to such an extent that the resultant mixture of vapor will not burn.

In the "Fire Test Procedures for Equivalent Sprinkler Systems in Accommodation, Public Spaces and Service Areas on Passenger Ships" described in IMO Resolution A.800(19), factors (1) and (2) are primarily involved in the case of accommodation, service, and Class A combustible storage compartments, as well as in narrow corridors. In the case of public spaces, wide corridors, and other well ventilated large deck area spaces, factors (3) and (4) are primarily involved. In the case of Class B flammable liquid storage areas, factors (1), (2), and (5) are normally involved.

The amount of evaporation, and hence the amount of heat extracted from the fire (i.e., cooling of the combustibles), is a function of the surface area of the water droplets applied for a given volume. Reducing droplet size increases total surface area, which in turn increases the cooling effect of a given volumetric flow rate of water. However, just having smaller droplet sizes does not necessarily mean better performance because the droplets must have the necessary momentum to be driven to the seat of the fire where they can provide rapid cooling and expansion to deny the fire of oxygen.

When water converts to vapor, it expands by about 1650 times, displacing and diluting oxygen in the fire area, thereby blocking the access of oxygen to the fuel. Arsonist fires in compartments, with their relatively rapid rate of heat release, are the easiest for water mist systems to extinguish due to the rapid vaporization which can occur with the relatively high level of heat present at nozzle operation.

In addition to the pre-wetting and cooling of the flames by vaporizing water droplets, fire extinguishment can be further enhanced by direct contact of the water droplets with the burning fuel to prevent further generation of the combustible vapors. This mode of fire extinguishment, which is normally associated with traditional sprinklers, tends to become more important as the degree of ventilation of the fire is increased.

Small droplets tend to remain suspended with the slightest of air currents. This temporary suspension results in a mist that is distributed throughout a protected space, to areas outside of the direct spray range of an individual nozzle. Under the influence of draft effects, water droplets are more likely to be drawn into the seat of the fire, where they can be rapidly vaporized. This three dimensional effect of the mist circulating around the space also helps to cool gases and other fuels in the area, blocking transfer of radiant heat to adjacent combustibles, as well as pre-wetting them.

The flow rate "Q" from a water mist nozzle of the invention, in which a single stream of water is discharged from the outlet orifice, expressed in U.S. gallons per minute (gpm), is determined by the formula:

$$Q=K\ (p)^{1/2}$$

where: "K" represents the nominal nozzle discharge coefficient (normally referred to as K-factor), and "p" represents the residual (flowing) pressure at the inlet to the nozzle in pounds per square inch (psi).

In the case of a diffuser impingement nozzle operating by impacting a relatively coherent, single water jet against a diffuser, the normal range of K-factors is in the range of about 0.10 to about 1.00, preferably in the range from about 0.15 to 0.70, and more preferably in the range of about 0.50 to about 0.70, the latter range being found more preferable from the standpoint of minimizing fire protection system installation costs and running power requirements (for a continuous flow system) by maximizing protection area per nozzle as well as minimizing nozzle flow rate and residual (flowing) pressure. Generally speaking, low pressure diffuser impingement water mist nozzles are normally limited to a minimum K-factor of about 0.10 since, at lower K-factors, droplets will have insufficient momentum to drive to the seat of a fire, except in relatively small or minimal draft enclosures.

Also, in the general case, low pressure diffuser impingement water mist nozzles are normally limited to a maximum K-factor of about 1.0, since at higher K-factors, many of the droplets become too large to effectively vaporize and extract heat from a fire by cooling as well as reducing oxygen levels near the seat of a fire.

In addition, with larger K-factors, less mist is developed to envelop the protected area and block transfer of radiant heat to adjacent combustibles.

The shape of the water spray pattern directly affects circulation of air in the vicinity of a discharging sprinkler. By shaping the diffuser of a pendent-type water mist nozzle, which operates by impacting a single, relatively coherent fluid jet against the diffuser, so that the spray is directed primarily radially outward in an umbrella-shaped pattern (i.e., initially generally parallel to the ceiling under which the nozzle is located), the thrust of the water spray is directed so that air along the ceiling is entrained by the water flow and swept outward and away from the nozzle. At the edges of the spray pattern, the air descends and circulates inward along the floor towards the center of the spray pattern, where it billows up, similar to a rising cumulus cloud.

Alternatively, by configuring the diffuser so that water is directed primarily downward in a more conical-shaped pattern, the thrust of the water spray is such that air is entrained by the downwardly directed water and draws air in along the ceiling towards the nozzle to establish a different overall circulation pattern. Depending on the intended fire protection application of a nozzle, either spray and circulation pattern, or even a superimposed combination of an outer umbrella-shaped and an inner conical-shaped pattern, may be desired, and the spray pattern of the nozzle can be structured accordingly.

According to the present invention, it has been found that a superimposed combination of the outer umbrella-shaped and inner conical-shaped spray patterns is preferable for an automatic, pendent-type, diffuser impingement, water mist nozzle intended for fire protection service in marine applications involving public spaces up to 5 m (16.4 ft.) high, luxury cabins, wide corridors, and similar rated occupancies. Furthermore, for such a nozzle, it has been found that it is more preferable for the portion of the spray forming the outer umbrella-shaped pattern to be substantially continuous in elevation around its upper peripheral region, and as close to the ceiling as practical, without causing cold soldering of adjacent nozzles.

This arrangement provides the benefits of minimizing growth of fires along walls by maintaining high wall wetting and of helping to prevent combustion gases from escaping from the fire area along the ceiling which, in turn, tends to reduce the amount of fresh air drawn along the floor into the fire area.

Heretofore, it has been known that the parameters which establish spray patterns and, hence circulation patterns of a pendent-type diffuser impingement nozzle operating by impacting a single, relatively coherent water jet against a substantially horizontal diffuser, include:

the form or shape of the diffuser;

the outside dimensions of the diffuser;

the shape and arrangements of openings and tines located around the periphery of the diffuser; and the shape, size, and arrangement of holes located within the central area of the diffuser, when such holes are utilized in conjunction with holes and tines located around the periphery of the diffuser.

In fact, it has been well known that use of a substantially horizontal diffuser, with a series of openings and tines located around the periphery of the diffuser, is capable of producing an umbrella-shaped spray pattern. However, such designs produce an umbrella-shaped pattern which is not substantially continuous in elevation around the upper peripheral region of the spray because of the portion of the water directed radially downward through openings between the tines. Utilizing openings around the periphery that are in the shape of slots which are narrow relative to the peripheral width of the adjacent tines tends to create an umbrella shaped pattern which is more continuous in elevation around the upper peripheral region of the spray, but this also tends to create a spray pattern having an outer dimension that is excessively sensitive to the residual (flowing) pressure at the inlet to the nozzle, without fully achieving an umbrella shaped pattern that is substantially continuous in elevation around the upper peripheral region of the spray.

It has now been found, however, that, according to the invention, a superimposed combination of an outer umbrella-shaped and inner conical-shaped spray pattern preferred for the extinguishment, suppression or control by pendent-type water mist nozzles of fires in marine occupancies such as public spaces, luxury cabins and wide corridors can be obtained by use of a formed diffuser having holes located within the central area of the diffuser and which is substantially free of openings and tines located around the periphery of the diffuser. The combination of the form and outside diameter of the diffuser of the invention essentially determines the character of the outer umbrella-shape pattern and the area which can be suitably protected by the nozzle, while the size, arrangement and shape of the holes located within the central area of the diffuser essentially determines the character of the inner conical-shaped pattern established beneath and within the umbrella-shaped pattern, as well as the amount of water distributed within the area beneath the nozzle.

Automatic sprinklers of the upright type, with holes within the central area of a deflector substantially free of openings and tines around the periphery are depicted by Kersteter U.S. Pat. No. 400,688; Nagle U.S. Pat. No. 447,004; and Beyers U.S. Pat. No. 450,574. However, the water distribution characteristics of these sprinklers follow the common design practice of that time, i.e. they are designed to spray roughly equivalent amounts of water downward towards the floor and upwards towards the ceiling.

These and other features and advantages of the invention will be apparent from the following description of a presently preferred embodiment, and from the claims.

DESCRIPTION OF THE PEFERRED EMBODIMENTS

Figure 1:
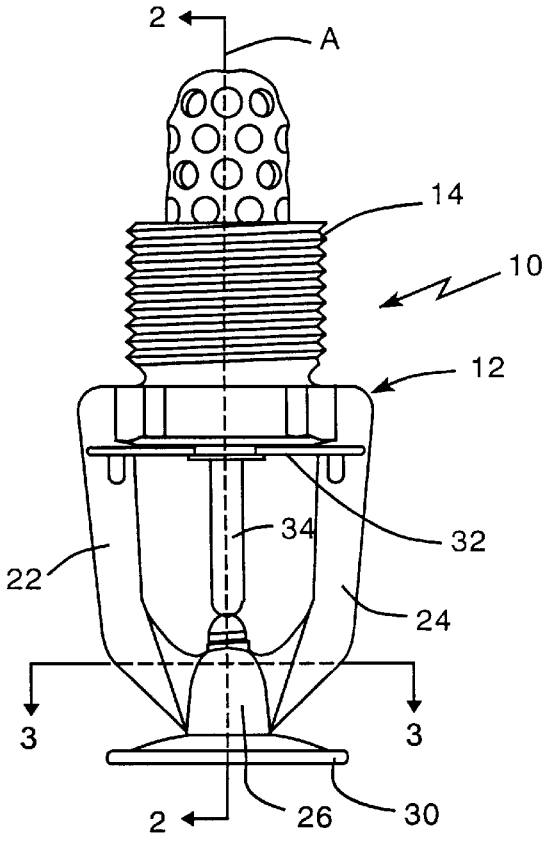
FIG. 1 is a side elevational view of a pendent-type diffuser impingement water mist fire protection nozzle of the invention.
Figure 2:
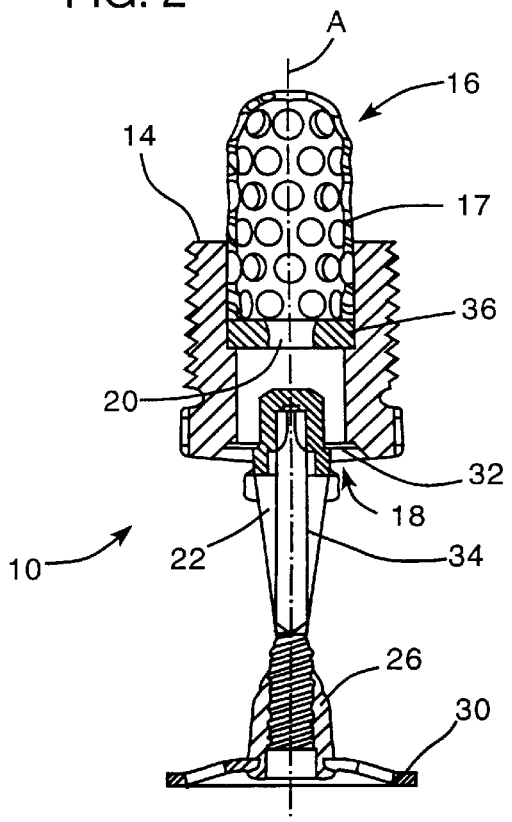
FIG. 2 is a side section view of the water mist fire protection nozzle taken at the line 2—2 of FIG. 1.
Figure 3:
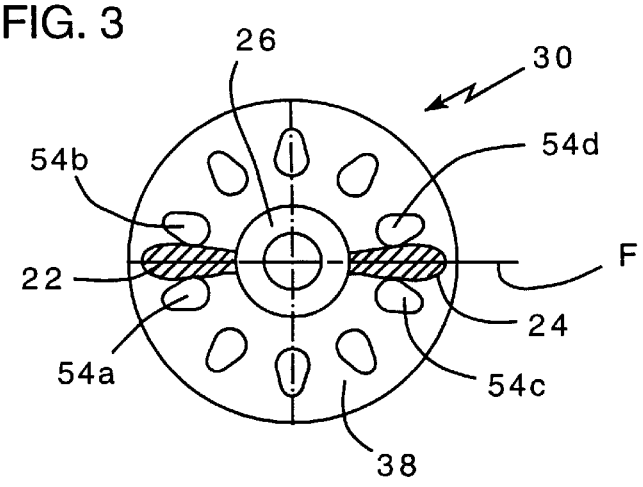
FIG. 3 is a top section view of the water mist fire protection nozzle taken at the line 3—3 of FIG. 1.

Referring to FIGS. 1–3, a pendent-type, diffuser impingement water mist nozzle 10 of the invention has a body 12 with a base 14 defining an inlet 16 for connection to a source of water under pressure (not shown), an outlet 18 with an axis, A, and an orifice 20, which is normally just upstream of, and coaxial with, the outlet. A strainer 17 is located at the inlet 16 to prevent debris larger than a preselected combination of dimensions from clogging water flow through orifice 20. A pair of U-shaped frame arms 22, 24 are attached to opposite sides of the base 14 and join at an apex 26 positioned downstream of, and coaxial with, the outlet 18. A substantially horizontal water distribution diffuser 30 is affixed to, and disposed coaxial with, the apex 26.

Figure 4:
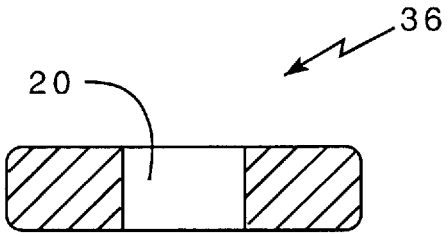
FIG. 4 is an enlarged side section view of the orifice insert of the water mist fire protection nozzle of FIG. 2.

The outlet 18 of the diffuser impingement nozzle 10 of the invention is normally closed by a plug 32, which is held in place by a thermally responsive element 34, e.g. frangible glass bulb, which is configured to burst apart and automatically release the plug 32 when the thermally responsive element is heated to within a specified operating temperature range for a preselected nominal temperature rating, e.g. as 68° C. (155° F.). In the preferred embodiment, the thermally responsive element 34 is a nominally 3 mm (0.12 inch) diameter frangible glass bulb, available, e.g. in temperature ratings of 57° C. (135° F.), 68° C. (155° F.), 79° C. (175° F.) and 93° C. (200° F.). Upon release of the plug 32, a vertically directed, relatively coherent, single stream of water passing through an orifice insert 36 (FIGS. 3 and 4) rushes downward from the outlet 18 towards the diffuser 30. The water stream from the outlet 18 impacting upon the opposed surface 38 of the diffuser 30 is diverted generally radially downward and outward by the diffuser, breaking up into a spray pattern consisting of a superimposed combination of an outer umbrella-shaped pattern component and an inner conical-shaped pattern component, the configuration of the spray pattern being primarily a function of the diffuser design.

Referring also to FIGS. 5–8, the diffuser 30 of the impingement, water mist nozzle 10 of the invention has an outside diameter, $D_f$, in the formed (final) state (FIGS. 5 and 6), e.g. a uniform value of about 0.995 inch, and an outside diameter, $D_b$, in the blank state (FIGS. 7 and 8), e.g. a uniform value of about 1.000 inch. The blank form of the diffuser is labeled as 30' in FIGS. 7 and 8 to distinguish from the final, formed state of diffuser 30 in FIGS. 1–3 and 5–6.) The diffuser 30, which has a thickness, T, e.g. about 0.051 inch, is fabricated from a phosphor bronze alloy UNS52100, Temper H02, per ASTM B103.

Figure 5:
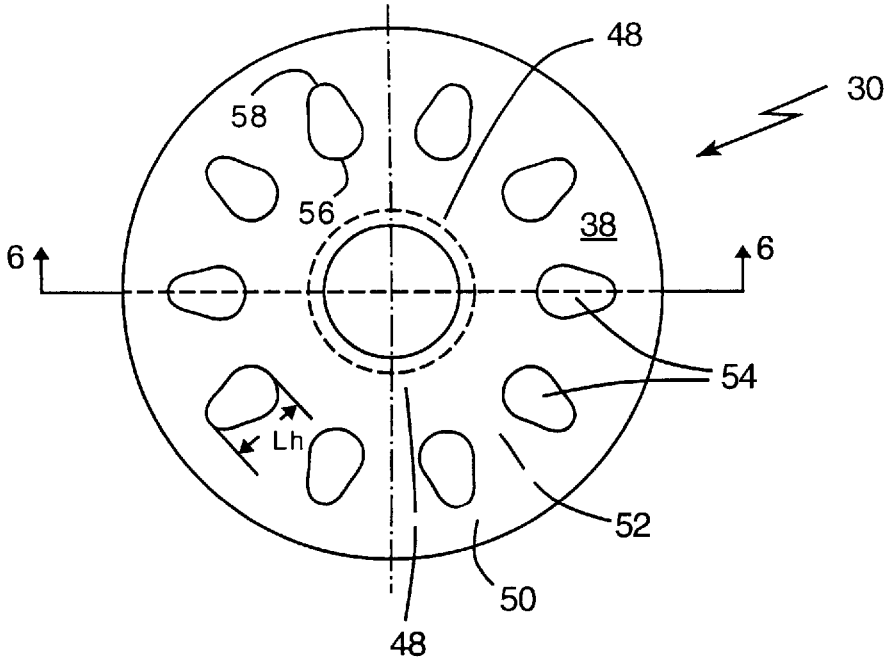
FIG. 5 is a top plan view of the diffuser element of the water mist fire protection nozzle of FIG. 1.
Figure 6:
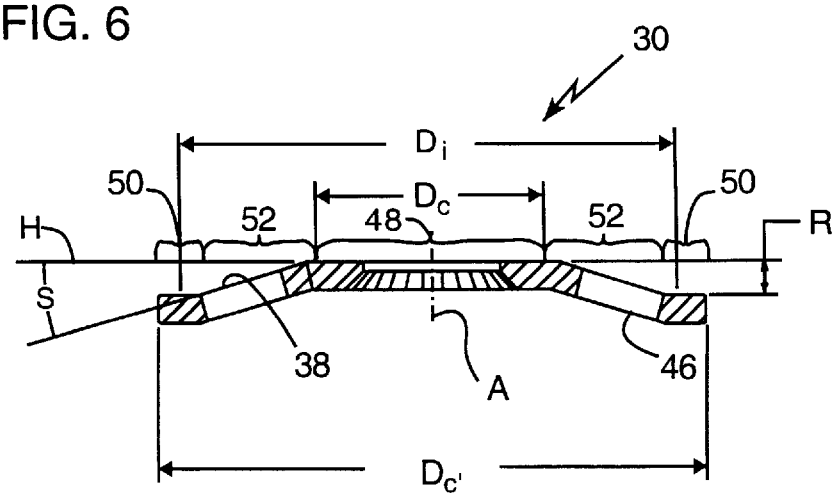
FIG. 6 is a side section view of the diffuser element of the water mist fire protection nozzle taken at the line 6—6 of FIG. 5.

Referring to FIGS. 5 and 6, in the formed state, the diffuser 30 has an inside surface 38 downstream of, and facing towards, i.e. opposing, the nozzle outlet 18 and an outside surface 46 on the opposite side of the diffuser, i.e. facing away from the nozzle outlet. The inside surface 38 of the diffuser 30 defines a substantially flat, central base area 48 having an outer diameter, $D_c$, e.g. of about 0.414 inch. The inside surface 38 also defines a substantially flat outer area 50 which is coaxial with the base area 48, the outer area 50 having an inner diameter, $D_i$, e.g. of about 0.900 inch, and being recessed, i.e. positioned further away, by a vertical distance, R, e.g. about 0.059 inch, from the nozzle outlet 18, relative to the base area 48. The inside surface 38 of the diffuser 30 further defines a generally annular intermediate region 52, between the base area 48 and the outer area 50, the intermediate region 52 having the general shape of a truncated cone slanted at a downward angle, S, e.g. in the range of about 4° C. to 60° C., preferably about 10° C. to 30° C., and more preferably about 18° C., relative to a plane, H, of the horizontal base area 48.

Figure 7:
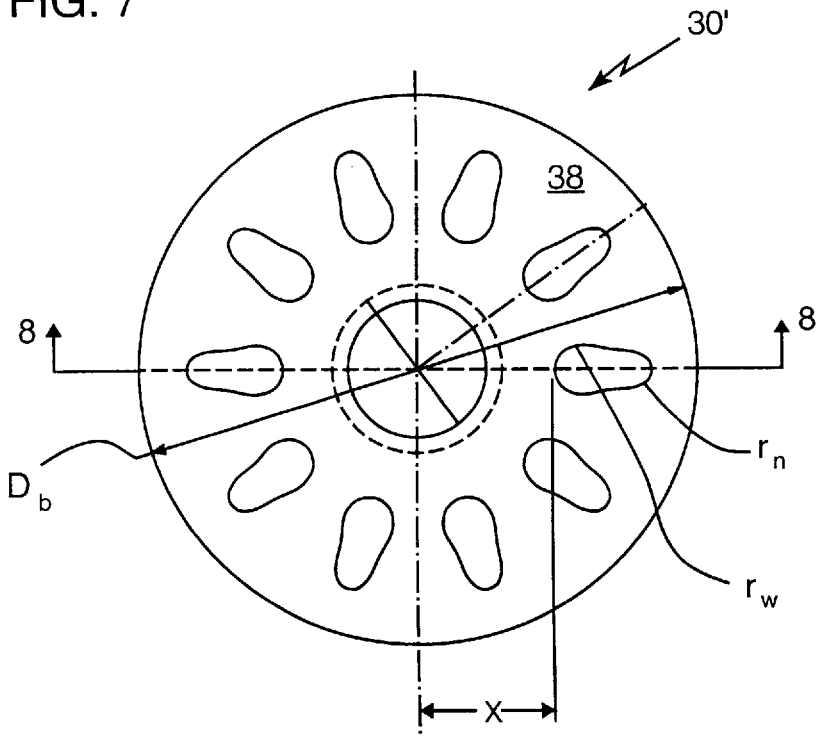
FIG. 7 is a top plan view of a blank for forming the diffuser element of the water mist fire protection nozzle of FIG. 1.
Figure 8:
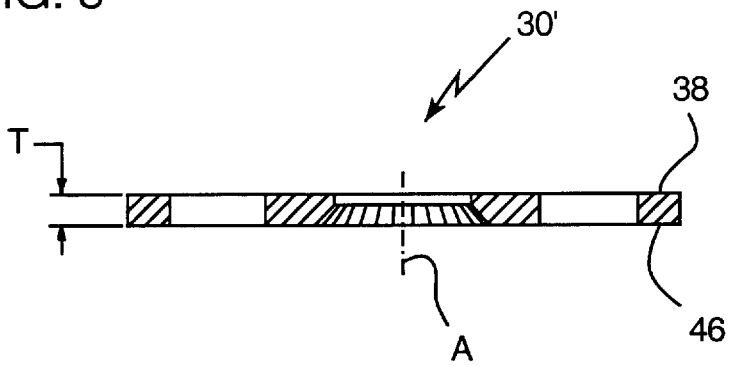
FIG. 8 is a side section view of the blank for forming the diffuser element of the water mist fire protection nozzle taken at the line 8—8 of FIG. 7.

A plurality of equally spaced holes 54, e.g. at least about four or eight hole, and preferably about ten holes, as shown in FIGS. 3, 5 and 7, are symmetrically located through the diffuser 30 in the slanted intermediate region 52, extending between the inside surface 38 in the intermediate region 52 and the opposite outside surface 46. The holes 54 are pear-shaped in the flat (blank) state of the diffuser 30', with the wider end 56 of each hole 54 having a radius, $r_w$, e.g. in the range of about 0.03 inch to about 0.09 inch, and preferably about 0.046 inch, and being closer to the axis, A, of the outlet 18 than the narrower end 58 of each hole, which has a radius, $r_n$, e.g. in the range of about 0.02 inch to about 0.07 inch, and preferably about 0.032 inch. In the blank (flat) state (FIGS. 7 and 8), the holes 54 having over-all radial lengths, $L_h$, e.g. in the range of about 0.10 inch to about 0.25 inch, and preferably about 0.174 inch. Each of the holes 54 is also positioned at a radial distance, X, e.g. in the range of about 0.15 inch to about 0.45 inch, and preferably in the range of about 0.250 inch, from the axis, A, of the diffuser 30', measured in the flat (blank) state.

In addition, referring to FIG. 3, in the preferred embodiment, the diffuser 30 is positioned relative to a plane, F, of the nozzle frame arms 22, 24, so that adjacent pairs of holes 54, e.g. holes 54*a*, 54*b* and holes 54*c*, 54*d*, through the slanted intermediate region 52 of the diffuser 30 are equally spaced from the plane, F, of the nozzle frame arms.

A commercial embodiment of the water mist nozzle 10 of the invention is represented by a 0.64 K-factor Model AM22 AquaMist® Nozzle, as manufactured by Grinnell Corporation, 3 Tyco Park, Exeter, NH 03833.

Other embodiments are within the following claims. For example, the orifice 20 may have a non-circular cross-section. The nozzle 10 may have a K-factor in the range of about 0.10 to 1.00, preferably in the range from about 0.15 to 0.70, and more preferably in the range of about 0.50 to about 0.70. Fewer or more holes 54 may be defined in the intermediate region 52 of the diffuser 30. The peripheral shape of the outer area 50 of the diffuser 30 may be provided with non-substantive undulations. The diffuser 30 may also have non-substantive variations in the shape and dimensions of the holes 54 through the intermediate region 52 of the diffuser inner surface 38, e.g. in length, $L_h$, radius, $r_n$ and/or $r_w$, and/or radial distance, X, from the axis, A. The diffuser 30 may also have non-substantive variations in the angle, S, of the inner surface 38 in the intermediate region 52, in the distance ($D_c$ less $D_i$) between the diffuser base area 48 and the outer area 50; and in the peripheral shape of the outer area 50 of the diffuser 30. All of the above are applied without departing from the spirit and scope of this invention.

What is claimed is:

1. A pendent-type diffuser impingement water mist fire protection nozzle comprising:

a body defining an orifice and an outlet for flow of fluid from a source, said orifice defining an axis, and said outlet being disposed generally coaxial with said orifice, and a diffuser disposed generally coaxial with said axis of said orifice and positioned for impingement of the flow of fluid thereupon, said diffuser defining an inner surface opposed to water flow from said outlet and an opposite outer surface, said inner surface defining:

a generally horizontal base area facing said nozzle outlet, an outer area spaced radially outwardly from, and disposed further from said outlet relative to, said base area, said outer area defining a generally continuous, circumferential peripheral edge, and an intermediate region extending between said base area and said outer area, said intermediate region defining a slanted surface disposed at a predetermined acute angle to the horizontal, said slanted surface defining a plurality of through holes from said inner surface of said diffuser to said opposite outer surfaces, each through hole of said plurality of through holes defined by said slanted surface having a first end and a second end, said first end being closer to said axis than said second end, said second end being defined by a wall inclined inwardly toward said axis and defining a wall surface opposed to water flow from said outlet.

2. A pendent-type diffuser impingement water mist fire protection nozzle comprising:

a body defining an orifice and an outlet for flow of fluid from a source, said orifice defining an axis, and said outlet being disposed generally coaxial with said orifice, and a diffuser disposed generally coaxial with said axis of said orifice and positioned for impingement of the flow of fluid thereupon, said diffuser defining an inner surface opposed to water flow from said outlet and an opposite outer surface, said inner surface defining:

a generally horizontal base area facing said nozzle outlet, an outer area spaced radially outwardly from, and disposed further from said outlet relative to, said base area, said outer area defining a generally continuous, circumferential peripheral edge, and an intermediate region extending between said base area and said outer area, said intermediate region defining a slanted surface disposed at a predetermined acute angle to the horizontal, said slanted surface defining a plurality of through holes from said inner surface of said diffuser to said opposite outer surface, each through hole of said plurality of through holes defined by said slanted surface having a first, relatively wider end and a second, relatively narrower end, said first, relatively wider end being closer to said axis than said second, relatively narrower end.

3. The pendent-type diffuser impingement water mist fire protection nozzle of claim 1 wherein said predetermined acute angle of said slanted surface is in the range of about 4° C. to 60° C.

4. The pendent-type diffuser impingement water mist fire protection nozzle of claim 3 wherein said predetermined acute angle of said slanted surface is in the range of about 10° C. to 30° C.

5. The pendent-type diffuser impingement water mist fire protection nozzle of claim 4 wherein said predetermined acute angle of said slanted surface is about 18° C.

6. The pendent-type diffuser impingement water mist fire protection nozzle of claim 1 wherein said plurality of through holes defined by said slanted surface comprises at least four through holes.

7. The pendent-type diffuser impingement water mist fire protection nozzle of claim 6 wherein said plurality of through holes defined by said slanted surface comprises at least eight through holes.

8. The pendent-type diffuser impingement water mist fire protection nozzle of claim 7 wherein said plurality of through holes defined by said slanted surface comprises ten through holes.

9. The pendent-type diffuser impingement water mist fire protection nozzle of claim 1, 3, 4, 5, 6, 7, or 8 wherein through holes of said plurality of through holes defined by said slanted surface have a length in the range of about 0.10 inch to about 0.25 inch, measured in a flat, blank form of said diffuser.

10. The pendent-type diffuser impingement water mist fire protection nozzle of claim 9 wherein through holes of said plurality of through holes defined by said slanted surface have a length of about 0.174 inch.

11. The pendent-type diffuser impingement water mist fire protection nozzle of claim 1, 3, 4, 5, 6, 7 or 8 wherein said plurality of through holes defined by said slanted surface are generally equally spaced about said axis.

12. The pendent-type diffuser impingement water mist fire protection nozzle of claim 1, 3, 4, 5, 6, 7 or 8 wherein said plurality of through holes defined by said slanted surface are generally equally spaced from said axis at a distance in the range of about 0.15 inch to about 0.45 inch, measured in a flat, blank form of said diffuser.

13. The pendent-type diffuser impingement water mist fire protection nozzle of claim 12 wherein said plurality of through holes defined by said slanted surface are generally equally spaced from said axis at a distance of about 0.250 inch, measured in a flat, blank form of said diffuser.

14. The pendent-type diffuser impingement water mist fire protection nozzle of claim 1 wherein said outer area spaced radially outwardly from, and disposed further from said outlet relative to, said base area has an inner diameter of about 0.900 inch.

15. The pendent-type diffuser impingement water mist fire protection nozzle of claim 1 or 14 wherein said outer area is disposed further from said outlet relative to said base area by a vertical distance of about 0.059 inch.

16. The pendent-type diffuser impingement water mist fire protection nozzle of claim 1 or 14 wherein said diffuser, in final, formed state, has an outer diameter of about 0.995 inch.

17. The pendent-type diffuser impingement water mist fire protection nozzle of claim 1 wherein said diffuser, in flat, blank state, has an outer diameter of about 1.000 inch.

18. The pendent-type diffuser impingement water mist fire protection nozzle of claim 1 further comprising a spray pattern of water flow from said outlet impacted upon said diffuser, said spray pattern comprising a superimposed combination of an outer umbrella-shaped pattern component and an inner conical-shaped pattern component.

19. The pendent-type diffuser impingement water mist fire protection nozzle of claim 1 or 18 wherein said nozzle has a K-factor in the range of about 0.10 to about 1.0.

20. The pendent-type diffuser impingement water mist fire protection nozzle of claim 19 wherein said nozzle has a K-factor in the range of about 0.15 to about 0.70.

21. The pendent-type diffuser impingement water mist fire protection nozzle of claim 20 wherein said nozzle has a K-factor in the range of about 0.50 to about 0.70.

22. The pendent-type diffuser impingement water mist fire protection nozzle of claim 2 wherein said predetermined acute angle of said slanted surface is in the range of about 4° C. to 60° C.

23. The pendent-type diffuser impingement water mist fire protection nozzle of claim 22 wherein said predetermined acute angle of said slanted surface is in the range of about 10° C. to 30° C.

24. The pendent-type diffuser impingement water mist fire protection nozzle of claim 23 wherein said predetermined acute angle of said slanted surface is about 18° C.

25. The pendent-type diffuser impingement water mist fire protection nozzle of claim 2 wherein said plurality of through holes defined by said slanted surface comprises at least four through holes.

26. The pendent-type diffuser impingement water mist fire protection nozzle of claim 25 wherein said plurality of through holes defined by said slanted surface comprises at least eight through holes.

27. The pendent-type diffuser impingement water mist fire protection nozzle of claim 26 wherein said plurality of through holes defined by said slanted surface comprises ten through holes.

28. The pendent-type diffuser impingement water mist fire protection nozzle of claim 2, 22, 23, 24, 25, 26, or 27, wherein said first, relatively wider end has a radius in the range of about 0.03 inch to about 0.09 inch, and said second, relatively narrower end has a radius in the range of about 0.02 inch to about 0.07 inch, measured in a flat, blank form of said diffuser.

29. The pendent-type diffuser impingement water mist fire protection nozzle of claim 28 wherein said first, relatively wider end has a radius of about 0.046 inch, and said second, relatively narrower end has a radius of about 0.032 inch, measured in a flat, blank form of said diffuser.

30. The pendent-type diffuser impingement water mist fire protection nozzle of claim 2, 22, 23, 24, 25, 26, or 27 wherein said plurality of through holes defined by said slanted surface are generally equally spaced about said axis.

31. The pendent-type diffuser impingement water mist fire protection nozzle of claim 2, 22, 23, 24, 25, 26, or 27 wherein said plurality of through holes defined by said slanted surface are generally equally spaced from said axis at a distance in the range of about 0.15 inch to about 0.45 inch, measured in a flat, blank form of said diffuser.

32. The pendent-type diffuser impingement water mist fire protection nozzle of claim 31 wherein said plurality of through nozzle defined by said slanted surface are generally equally spaced from said axis at a distance of about 0.250 inch, measured in a flat, blank form of said diffuser.

33. The pendent-type diffuser impingement water mist fire protection nozzle of claim 2, 22, 23, 24, 25, 26, or 27 wherein through holes of said plurality of through holes defined by said slanted surface have a length in the range of about 0.10 inch to about 0.25 inch, measured in a flat, blank form of said diffuser.

34. The pendent-type diffuser impingement water mist fire protection nozzle of claim 33 wherein through holes of said plurality of through holes defined by said slanted surface have a length of about 0.174 inch.

35. The pendent-type diffuser impingement water mist fire protection nozzle of claim 2 wherein said outer area spaced radially outwardly from, and disposed further from said outlet relative to, said base area has an inner diameter of about 0.900 inch.

36. The pendent-type diffuser impingement water mist fire protection nozzle of claim 2 or 35 wherein said outer area is disposed further from said outlet relative to said base area by a vertical distance of about 0.059 inch.

37. The pendent-type diffuser impingement water mist fire protection nozzle of claim 2 or 35 wherein said diffuser, in final, formed state, has an outer diameter of about 0.995 inch.

38. The pendent-type diffuser impingement water mist fire protection nozzle of claim 2 further comprising a spray pattern of water flow from said outlet impacted upon said diffuser, said spray pattern comprising a superimposed combination of an outer umbrella-shaped pattern component and an inner conical-shaped pattern component.

39. The pendent-type diffuser impingement water mist fire protection nozzle of claim 2 or 38 wherein said nozzle has a K-factor in the range of about 0.10 to about 1.0.

40. The pendent-type diffuser impingement water mist fire protection nozzle of claim 39 wherein said nozzle has a K-factor in the range of about 0.15 to about 0.70.

41. The pendent-type diffuser impingement water mist fire protection nozzle of claim 40 wherein said nozzle has a K-factor in the range of about 0.50 to about 0.70.

42. The pendent-type diffuser impingement water mist fire protection nozzle of claim 1 or 2 further comprising a pair of nozzle frame arms extending from said body and disposed generally in a first plane including said axis, with said diffuser mounted thereupon, and adjacent pairs of said through holes positioned with equal spacing from said first plane extending therebetween.

43. The pendent-type diffuser impingement water mist fire protection nozzle of claim 1 or 2 wherein said generally horizontal base area facing said sprinkler outlet has an outer diameter of about 0.414 inch.

44. A pendent-type diffuser impingement water mist fire protection nozzle comprising:

a body defining an orifice, said orifice defining an axis, and an outlet for flow of fluid from a source, said outlet defining an outlet axis coaxial with the said axis of said orifice, and a diffuser disposed generally coaxial with said axis of said orifice and positioned for impingement of the flow of fluid thereupon, said diffuser defining an inner surface opposed to water flow from said outlet and an opposite outer surface, said inner surface defining:

a generally horizontal base area facing said nozzle outlet, an outer area spaced radially outwardly from, and disposed further from said outlet relative to, said base area, said outer area defining a generally continuous, circumferential peripheral edge, and an intermediate region extending between said base area and said outer area, said intermediate region defining a slanted surface disposed at a predetermined acute angle to the horizontal, said slanted surface defining a plurality of through holes from said inner surface of said diffuser to said opposite outer surface.

* * * * *